United States Patent [19]

Gerest

[11] Patent Number: 4,913,374

[45] Date of Patent: Apr. 3, 1990

[54] PAYING OUT DEVICE

[75] Inventor: Marcel Gerest, Paris, France

[73] Assignee: Altic S.a.r.l., Paris, France

[21] Appl. No.: 202,078

[22] Filed: Jun. 3, 1988

[30] Foreign Application Priority Data

Jun. 5, 1987 [FR] France ..... 87 07893

[51] Int. Cl.[4] ..... B65H 59/16

[52] U.S. Cl. ..... 242/155 R

[58] Field of Search ..... 242/147 R, 155 R, 155 M, 242/147 M, 148, 149, 150 R, 150 M, 151, 152, 153, 154, 156, 156.1, 156.2, 129.8, 128, 45

[56] References Cited

U.S. PATENT DOCUMENTS

| | | | |
|---|---|---|---|
| 2,661,914 | 12/1953 | Thom | 242/155 R |
| 2,714,494 | 8/1955 | Wentz | 242/155 R |
| 3,023,979 | 3/1962 | Megens et al. | 242/155 R |
| 3,072,361 | 1/1963 | Fuller | 242/155 M |
| 3,520,492 | 7/1970 | Brown | 242/155 R |
| 3,707,269 | 12/1972 | Gerest | 242/155 R |
| 3,837,598 | 9/1974 | Brown | 242/155 R |
| 4,526,329 | 7/1985 | Takeda | 242/155 M |
| 4,570,874 | 2/1986 | Takeda | 242/155 R X |

FOREIGN PATENT DOCUMENTS

| | | | |
|---|---|---|---|
| 1241232 | 8/1960 | France | 242/155 R |

*Primary Examiner*—Stanley N. Gilreath

*Attorney, Agent, or Firm*—Fishman, Dionne & Cantor

[57] ABSTRACT

This invention relates to a paying out device comprising, in the direction of unwinding of a filament, at least one wire clamp, an optional return pulley, a brake pulley and a sliding pulley mounted on one end of a dynamometer arm, the other end of which has a graduated sector with a mechanism for positioning the point of attachment of one end of the dynamometer spring. The opposite end of the spring acts on a system of regulating the braking torque. The dynamometer arm is mounted so as to occupy a working position substantially along one edge of the frame, while an output pulley is arranged with respect to the brake pulley and the arm such that, in the working position of the latter, the filament substantially forms a right angle between the brake pulley and the output pulley, passing through the pulley of the dynamometer arm in the working position.

2 Claims, 4 Drawing Sheets

PAYING OUT DEVICE

BACKGROUND OF THE INVENTION

This invention relates to a paying out device of the type comprising, in the direction of unwinding of a filament, at least one wire clamp, a return pulley, a brake pulley and a sliding pulley mounted on one end of a dynamometer arm. The other end of the arm has a graduated sector with means for positioning the point of attachment of one end of a dynamometer spring with the opposite end of the spring acting on a system for regulating the braking torque of the brake pulley in order to ensure automatic regulation of the tension of the filament on leaving the paying out device. All of these several elements are mounted on a support frame.

The invention relates more particularly to a paying out device for wires which is applicable to bobbin winding machines, paying out machines, cabling machines and, in general, all those apparatuses in which it is necessary to ensure constant tension of a known value on the filament during its unwinding. For the winding of a wire (for example, the winding of a motor or of an electrical transformer) to be carried out under a constant tension of the filament, it is necessary to exert on the latter a predetermined braking to give it the necessary tension.

Moreover, the paying out device of the present invention must also be satisfactory for starting up and stopping the winding. This regulation of the braking must remain satisfactory (and at the greatest possible speed) even if the winding to be carried out exerts pulses of a greater or lesser size.

Thus, for example, when a rectangular or polygonal casing is wound, the tension of the filament has a continuous component force (the only one, in the case of winding cylindrical casings) which is modulated by Pulses generated by the passage of edges, these pulses causing a break when the speed increases. On the other hand, to give a good output, the speed must be as great as possible.

Attempts to achieve both satisfactory braking and increased speed have been made with known devices such as is disclosed in French Pat. No. 76,577, British Pat. No. 1,317,042 and U.S. Pat. No. 3,707,269, all of the contents of which are incorporated herein by reference. All of these documents relate to a paying out device of the type described above. In this device, the tension of the filament is provided by the brake pulley, while the tension pulses generated by the winding are at best taken up by an oscillation of the dynamometer arm when it is in its working position. The correspondence of the tension of the filament to the braking force depends on the point of attachment of the spring, the tension of which is transmitted to the device for regulating the braking torque of the brake pulley 26.

Although this known type of paying out device functions in a satisfactory manner, it has constraints of positioning which can be awkward. Moreover, the control of the working position of the arm is not always convenient.

In the above mentioned constructions, the tension of the filament as a function of the rotation of the arm follows a sinusoidal pattern and, in the working position, the gradient is also considerable, and it would be desirable for this to be reduced in order that the regulated tension of the filament should change as little as possible when the arm is moved slightly away from its working position as a result of the pulses due to the winding to be carried out.

SUMMARY OF THE INVENTION

The above-discussed and other problems and deficiencies of the prior art are overcome or alleviated by the improved paying out device of the present invention wherein the conditions of use are facilitated and the technical performance is improved particularly with regard to the stability and the winding of rectangular casings.

In accordance with the present invention, the paying out device comprises a mechanism similar to that discussed above wherein, in a preferred embodiment, the dynamometer arm is mounted in pivoting manner on the support frame so as to occupy a working position which is substantially along an edge of the frame, while its part forming the slightly curved graduated sector substantially extends along this same edge or is parallel to it in the working position. Also, an output pulley is arranged with respect to the brake pulley and the arm such that, in the working position of the latter, the filament substantially forms a right angle between the brake pulley and the output pulley, passing through the pulley of the dynamometer arm in the working position.

The working position of the arm along the edge of the frame can very easily be observed and consequently it is always possible to operate the paying out device of the present invention under optimum conditions without strict scrutiny.

Given that the filament leaves the paying out device via an output pulley mounted on the frame, there are no longer any constraints for the positioning of the paying out device with respect to the bobbin winding machine, and the filament can leave the paying out device in any direction.

In accordance with another feature of the present invention, the opening of the wire clamp can be carried out by means of a control which pivots so as to latch in two positions. This control is accessible from the front face of the frame and comprises a milled knob for regulating the pressure of the wire grip. Closure of the wire clamp is effected by means of an operating handle pivoting in two positions with the aid of a spring. This operating handle is mounted on the front face of the frame between the wire clamp and the output pulley.

The control is located in the plane of the frame and not perpendicular thereto. It is unnecessary for the rear face to be accessible, which enables a right-hand paying out device and a left-hand paying out device to be connected with a minimum width. This same control also positions (against the output pulley) an element which prevents the filament from being disengaged. Installation is such that the hand which places the filament in the apparatus can, after passing it around the output pulley, close the wire clamp and lock the output filament without letting go of the filament. It will be appreciated that this is extremely convenient.

The above-discussed and other features and advantages of the present invention will be appreciated and understood by those of ordinary skill in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
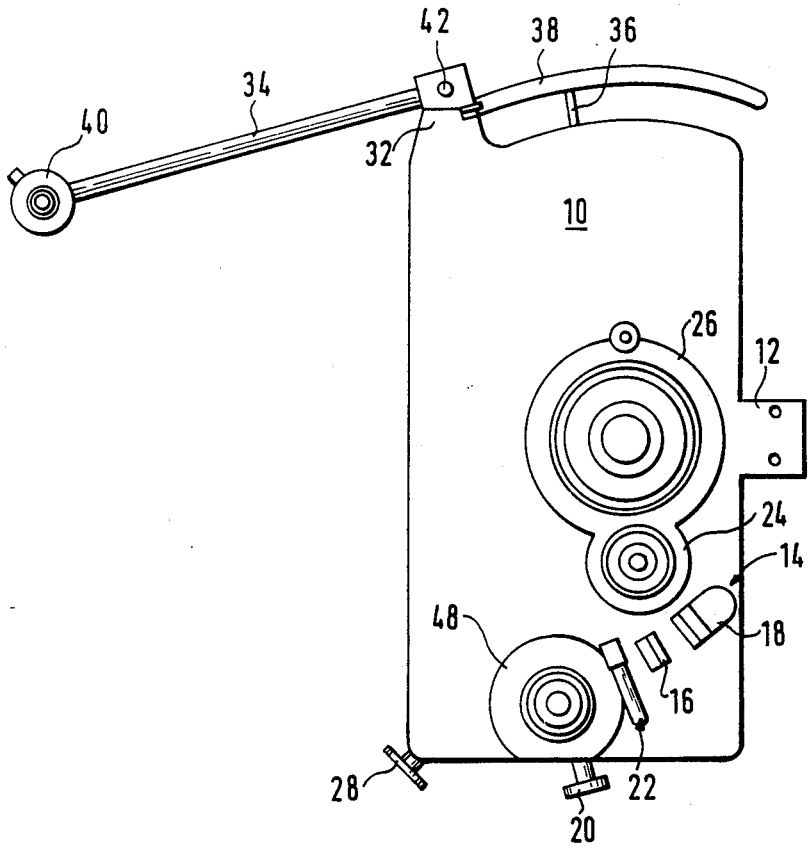
FIG. 1 is a diagrammatic side view of a paying out device of the present invention before a filament has been put in position.

The paying out device of the present invention is shown diagrammatically by a side view in FIG. 1. The essential elements of this device are mounted on a support frame 10 which is substantially rectangular and is provided with a side projection 12 enabling it to be fastened to a pin (not shown). A wire clamp is identified at 14 and comprises a stationary jaw 16 and a movable jaw 18, of which the gripping surfaces are coated with a layer of deformable material (for example, felt). FIG. 1 shows the open position of the wire clamp. A milled knob 20 extending beyond the base of the frame 10 (thus being easily accessible) enables the force of gripping of wire clamp 14 to be regulated. Knob 20, with the aid of a mechanism mounted on the rear face of frame 10 (which is not visible in the figure), also enables wire clamp 14 to be opened. To this end, knob 20 is displaced from the position in FIG. 2, corresponding to the closed position of wire clamp 14, towards the position in FIG. 1 to displace movable jaw 18. Although the opening of wire clamp 14 by displacement of knob 20 is carried out against the action of a spring, the open position is nevertheless a latched position, that is, a stable position. Closure of wire clamp 14 is carried out by pivoting the operating handle 22 of a filament stop from the position shown in FIG. 1 towards that of FIG. 2. This movement frees movable jaw 18, which stops automatically under the action of its spring (not shown). This same movement of operating handle 22 brings knob 20 back into the position of FIG. 2, corresponding to the closed position of wire clamp 14.

References 24 and 26 respectively, designate a return pulley and a brake pulley. It is the brake pulley 26, which by braking the progress of the filament, generates the necessary tension of the filament when leaving the paying out device. A milled knob 28, which is also accessible from the front face of frame 10, serves to modify the force of braking of pulley 26. The system of braking of pulley 26 and the control of the tension of the filament are located on the other side of frame 10 (and are not visible). However, given that these systems correspond to the known systems described in each of the above mentioned patents, they will not be described in further detail within the context of the present application, and the reader is advised to refer to one of these documents for more information concerning the design and functioning of these known systems of braking and control of the tension.

Figure 2:
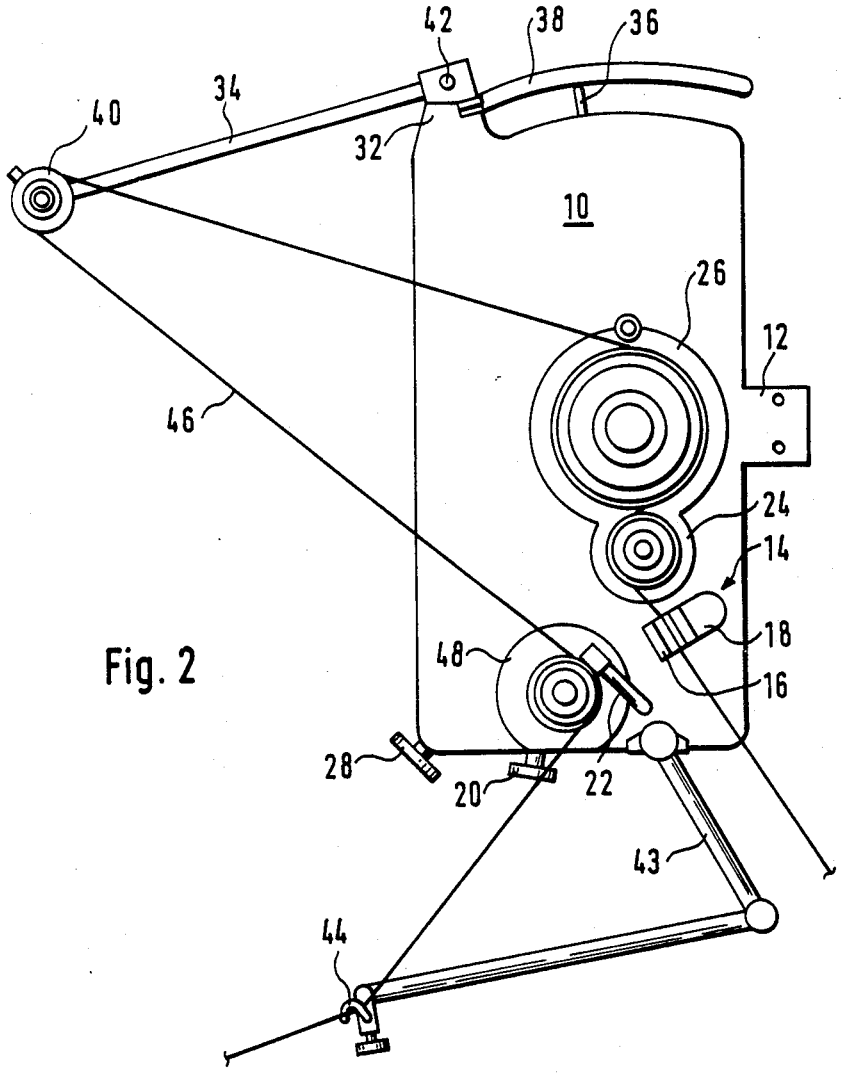
FIG. 2 is a diagrammatic side view showing the paying out device of FIG. 1 after the filament has been put in position.

The automatic regulation of tension is carried out in a manner known per se, with the aid of a dynamometer arm 34 which acts by way of a spring 36 on the braking system to automatically increase or decrease the braking torque exerted on pulley 26. Dynamometer arm 34 carries at its free end a pulley 40 and is mounted by means of its opposite end in pivoting manner on an elongated part 32 of frame 10. Arm 34 is extended beyond its axis of pivoting 42 by a graduated sector 38 to which there is attached the dynamometer spring 36 acting on the braking system. Sector 38 has a graduation in tension values corresponding to the range of operation of the paying out device. The marking of the tension values is such that the values progressively increase from the region of the axis of pivoting 42 towards the free end of the sector. The point of attachment of spring 36 to the graduated sector is displaceable along all the marks appearing on sector 38, for example, by means of a slide or by a serrated configuration of sector 38 which enables a hook at the free end of spring 36 to be received. The graduated sector is preferably in the shape of an arc of a circle, the radius of curvature corresponding to the length of spring 36 in the rest position as shown in FIG. 2. The filament to be wound leaves the paying out device by way of an output pulley 48.

In the case of winding by pulses, the filament located between the paying out device and the bobbin winding machine can be made to vibrate like a violin string, which can cause it to break. There may be fastened to the paying out device an articulated arm 43 enabling an eyelet or a pig-tail guide 44 to be placed in the path of the filament here, damping these vibrations and thus enabling faster operation.

The feed in position of a filament 46 is extremely simple. After opening wire clamp 14 by means of knob 20, the filament is passed successively, using only one hand, through wire clamp 14, around pulley 24, around pulley 26 and around the dynamometer pulley 40 and finally around output pulley 48. During passage around output pulley 48, the same hand can be used at the same time to actuate operating handle 22 to close wire clamp 14 and the filament stop, so that the paying out device and the filament 46 are then positioned as shown in FIG. 2.

Figure 3:
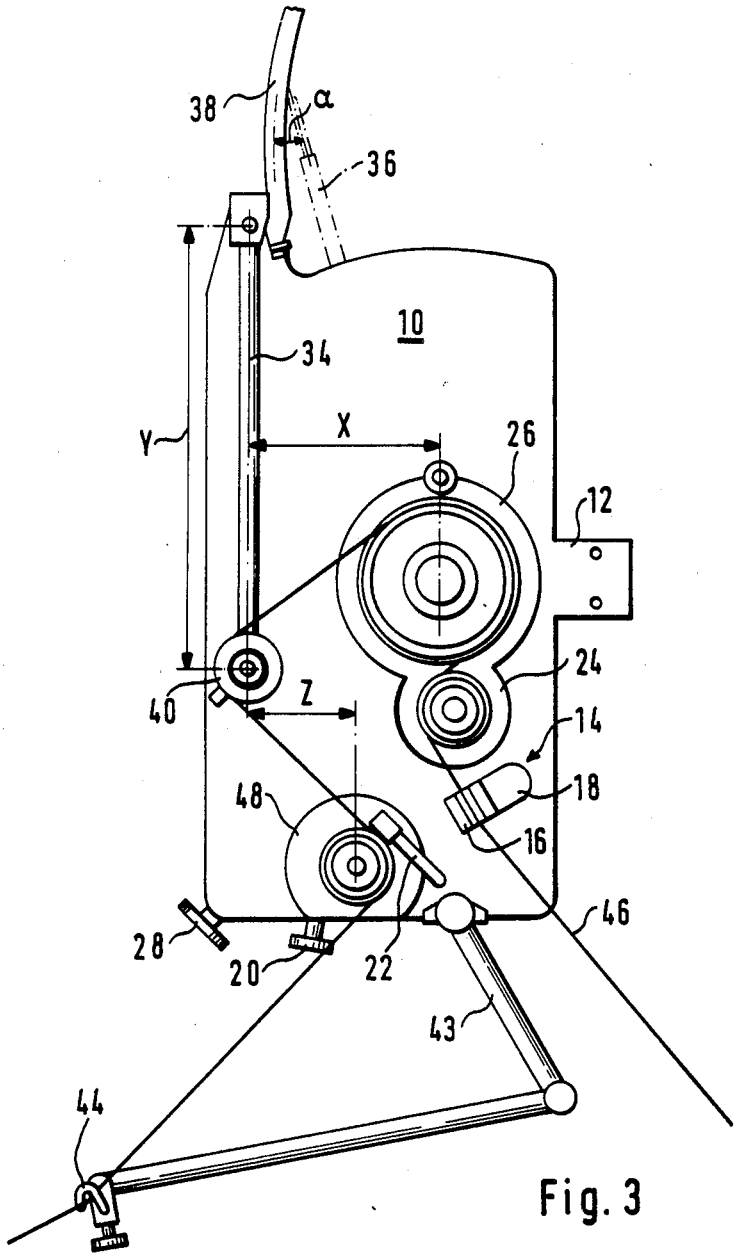
FIG. 3 is a diagrammatic side view showing the paying out device of FIG. 2 after regulation and ready for operation.

Regulation of the paying out device will now be explained with reference to FIGS. 2 and 3. After positioning filament 46, spring 36 is attached to sector 38 at the point corresponding to the desired winding tension. The braking system of pulley 26 is then tightened sufficiently, with the aid of knob 28, so pulley 26 will not turn when the filament is pulled at the output of pulley 48. Nor must the filament slide on brake pulley 26, or else it is necessary to grip wire clamp 14 more tightly with the aid of knob 20. The next operation consists of putting the dynamometer arm 34 in its working position. It should be noted here that, in the known paying out devices, the working position of the dynamometer arm corresponds approximately to the rest position of the paying out device of the present invention and is shown in FIG. 2 after the feed-in position of the filament. In contrast, the working position of dynamometer arm 34 is that shown in FIG. 3, where arm 34 is parallel to the longitudinal edge of frame 10, and where filament 46 passes around sliding pulley 40 such that the outgoing strand makes approximately a right angle with the incoming strand. This working position of arm 34 is very easy to mark and does not require much adroitness on the part of the operator. It is sufficient simply to pull on filament 46 at the output of pulley 48 until arm 34 pivots towards the position shown in FIG. 3, against the action of dynamometer spring 36 which is extended by graduated sector 38. In the position of FIG. 3, the brake is then released with the aid of knob 28, until pulley 26 begins to rotate to allow filament 46 to pass. Filament 46 can then be attached to the bobbin winding machine. It will be appreciated that when the bobbin winding machine reaches its working speed, it may be advantageous to correct the regulation of the braking with the aid of knob 28 so that arm 34 may be brought back into its working position, (in accordance with FIG. 3), if it has been displaced from the working position by the initiation of the winding, or if it was not precisely in that position previously.

In the position of FIG. 3, dynamometer arm 34 is always in equilibrium between a resisting torque due to the elongation of dynamometer spring 36 and a driving torque exerted by tension filament 46 under the action of the bobbin winding machining. When the latter is equal to the braking torque (which can be regulated by means of knob 28), the filament is freed by the rotation of pulley 26.

Of course, this equilibrium situation of arm 34 is not only produced in the working position of FIG. 3, but also in all of the intermediate positions between this and the rest position of FIG. 2 if regulation is carried out there. However, as will be demonstrated below, the working position according to FIG. 3 is the optimum working position, taking into account the opposite forces present.

The functioning of the paying out device described above is an analogue control. If, as a result of a momentary increase in the traction force during winding, the tension of the filament leaving the paying out device exceeds the tension shown on graduated sector 38, where the dynamometer spring 36 is attached, then arm 34 rotates, which brings about an elongation of dynamometer spring 36 and thus a signal on the regulating element of the torque of the brake pulley 26 which is reduced. Thus, a decrease in the braking force of pulley 26 reduces the tension of the filament until equilibrium is reestablished and enables dynamometer arm 34 to return to its working position parallel to the edge of panel 10.

Similarly, releasing the tension of the filament during winding enables arm 34 to pivot clockwise under the action of dynamometer spring 36. The contraction of the latter reduces its force acting on the regulating system of the braking torque, which increases the friction of the brake and the tension generated by pulley 26 on filament 46 until equilibrium is reestablished and arm 34 pivots towards its working position. Consequently, this system automatically regulates the braking torque of pulley 26 to ensure a constant tension of the filament 46 leaving the paying out device, despite the modifications of the driving torque exerted during winding on this filament.

Moreover, deviations of arm 34 from its working position have virtually no influence on the operating characteristics of the paying out device. To appreciate this, one need only analyze the opposing forces present.

First, the resisting torque exerted by the action of dynamometer spring 36 for different angular positions of arm 34 will be analyzed. An arbitrary position of dynamometer spring 36 on the graduated sector 38 is selected, for example 200 g. The table below indicates in column 1 the resisting torques exerted by spring 36 on arm 34 for the angular positions increasing from the rest position in 5° stages to 75°. These measurements were carried out with the aid of a torque meter connected to dynamometer pulley 40. This resisting torque increases, of course, as dynamometer spring extends. However, as sector 38 pivots, this increase is increasingly compensated by the fact that the force exerted by spring 36 decreases according to a sinusoidal function of the angle $\alpha$ between the graduated sector 38 and the spring 36, so that the maximum torque of 6 cm daN at 50° becomes 4.85 cmdaN at 75°, which is the working position.

Column II of the same table below shows the variations of the driving torque on the dynamometer arm 34 for a constant tension of 200 g in the vicinity of the working position of the dynamometer arm 34. To carry out this measurement, a constant tension on filament 46 below the output pulley 48 was applied with the aid of a 200 g weight; the filament 46 being locked at the entry of the paying out device, for example, in wire clamp 14. This driving torque is at a maximum when the direction of the filament between pulleys 40 and 48 is perpendicular to the arm 34, which is produced approximately in an angular position at 59° of arm 34. Beyond this angular position of arm 34, the angle between the latter and filament 46 increases and the resultant of the driving torque on the dynamometer arm 34 decreases progressively, to fall to 4.85 cmdaN in the working position at 75°, which corresponds exactly to the resisting torque in this working position.

By modifying parameters X, Y and Z (FIG. 3), both the shape of the curve of the resisting torque and that of the driving torque can be influenced. The angle $\alpha$, which is the determining parameter of the resisting torque, can in particular be modified by the ratio Y/X. An experimental value close to 2 for this ratio has proved satisfactory.

The installation of the brake pulley and the output pulley in relation to the dynamometer arm determines, by the distance Z, the variation of the angle of the filament when passing through the dynamometer pulley, that is, the progression in the driving torque.

STATIC MEASUREMENTS OF THE TORQUES

| Degree of rotation of the arm from the rest position | Col. I resisting torques Cm da N | Col. II torques on dynamometer arms at a constant tension of 200 g |
|---|---|---|
| 0 | | |
| 5 | 1.9 | |
| 10 | 2.75 | |
| 15 | 3.40 | |
| 20 | 4.12 | |
| 25 | 4.5 | |
| 30 | 5.10 | |
| 35 | 5.40 | |
| 40 | 5.75 | |
| 45 | 5.82 | 6.30 |
| 50 | 6. | 6.30 |
| 55 | 5.9 | 6.30 |
| 60 | 5.75 | 6.30 |
| 65 | 5.5 | 6. |
| 70 | 5.25 | 5.50 |
| 75 | 4.85 | 4.85 |

Figure 4:
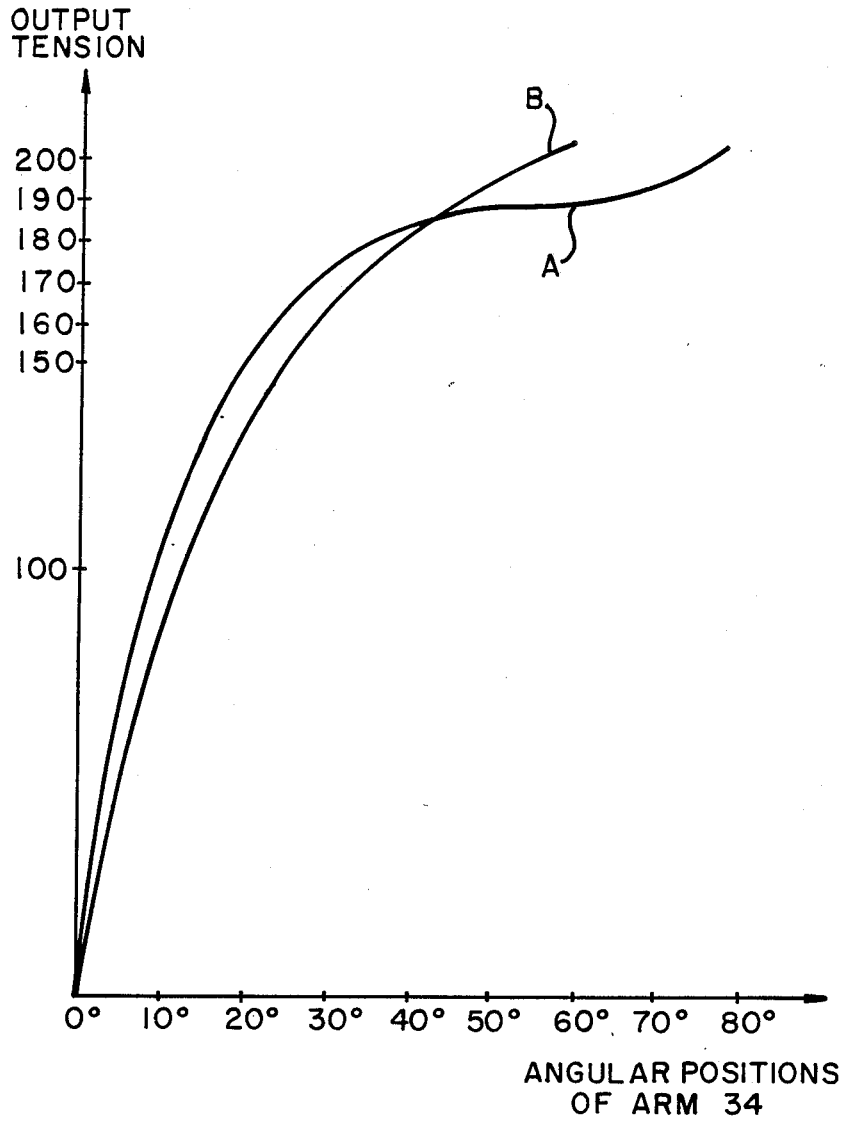
FIG. 4 is a curve illustrating the functioning of the paying out device provided by the present invention by comparison with that of a known paying out device.

The above table proves that the variations in torques generated by the extension of spring 36 on the one hand, and the movement of dynamometer pulley 40 on the other hand, are very close in the range of angular positions of arm 34 between 50° and 75°. This is an important characteristic, since this equilibrium ensures good stability for the paying out device which, for this reason, has a large range of use (partially horizontal), as compared with the known paying out devices, which have a narrower range of use and, moreover, a slightly inclined one. This is in fact evident from the graph shown in FIG. 4, which shows the characteristic curves resulting from superposition of the resisting torques and the driving torques of the above table for a paying out device in accordance with the present invention, in comparison with a known paying out device.

Curve A shows the effective tension of the filament in a paying out device in accordance with the present invention, for an initial setting of the apparatus at 200 g and for different angular positions of the dynamometer arm. Given that the laws governing both the driving torque and the resisting torque are practically identical above 40°, their superposition ensures a constant output tension, which is demonstrated by the fact that curve A becomes substantially horizontal from 40° onwards. If the preferred working position of the arm is that shown in FIG. 3, it should be noted that the acceptable working range extends from 40° to 80°.

Curve B is the result of corresponding measurements carried out on a paying out device of the prior art. For this paying out device, the working position of the dynamometer arm is at 50° with respect to its rest position. In contrast, as is shown by curve B, the actual tension of the filament decreases for smaller angular positions, while it increases above the working position. The acceptable working range is no broader than 10°.

The moving together of the laws governing the driving torque and the resisting torque, and the possibilities of easy modification of these laws by altering the distances X, Y and Z, consequently enable a relationship between the tension of the filament and the rotation of the arm, which has a broad bearing which is very favorable for the stability of functioning, the convenience of regulation and the carrying out of winding by pulses, to be obtained; while maintaining an analogue mechanical control.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A device for paying out a filament under tension, comprising:

a support panel having a first edge;

a wire clamp mounted on the support panel;

a brake pulley mounted on the support panel;

a dynamometer arm pivotably mounted on the support panel, said arm extending from a first end to a second end, said arm having a working position in which the arm extends substantially along the first edge of the panel;

a sliding pulley mounted on the first end of the arm;

a spring having a first end and a second end, said first end being attached to the arm at a point near the second end of the arm;

means for positioning the point at which the spring is attached to the arm;

means, attached to the second end of the spring and acting on the brake pulley for regulating the tension of the filament; and output pulley means mounted on the support panel such that the filament substantially forms a right angle in passing from the brake pulley through the sliding pulley to the output pulley when the dynamometer arm is in the working position.

2. The device of claim 1, additionally comprising:

an articulated arm having a first end, pivotably attached to the support panel and extending to a free second end;

a filament guide attached to the second end of the articulated arm for dampening vibration of paid out filament.

* * * * *